US005771716A

United States Patent [19]

Schlussel

[11] Patent Number: 5,771,716

[45] Date of Patent: Jun. 30, 1998

[54] WARP-KNITTED LOOP NET FABRIC

[76] Inventor: Edward Schlussel, 333 Longwood Crossing, Lawrence, N.Y. 11559

[21] Appl. No.: 529,424

[22] Filed: Sep. 18, 1995

[51] Int. Cl.[6] ..... D04B 21/14; D04B 21/10

[52] U.S. Cl. ..... 66/195; 66/193

[58] Field of Search ..... 66/191, 192, 193, 66/194, 195

[56] References Cited

U.S. PATENT DOCUMENTS

| | | | |
|---|---|---|---|
| 1,187,158 | 6/1916 | McGinley | 66/195 |
| 2,213,720 | 9/1940 | Seim | 66/193 X |
| 3,084,529 | 4/1963 | Scheibe | 66/193 |
| 3,118,294 | 1/1964 | Laethem | 66/193 |
| 3,183,685 | 5/1965 | Riehl | 66/193 |
| 3,258,941 | 7/1966 | Formenti | 66/193 |
| 3,314,251 | 4/1967 | Bünger | 66/193 |

*Primary Examiner*—John J. Calvert

*Attorney, Agent, or Firm*—Brumbaugh, Graves, Donohue & Raymond

[57] ABSTRACT

A warp-knitted loop net fabric comprises a first group of threads forming warp chains knitted by a front bar, a second group of threads guided by a second bar and forming lay-ins under underlaps of the first group of threads in every course of the warp chains, the underlaps of the warp chains of the first group of threads being loops formed by tensioning the threads of the second group, and a knitted net forming a groundwork incorporating the warp chains and lay-ins.

7 Claims, 3 Drawing Sheets

WARP-KNITTED LOOP NET FABRIC

BACKGROUND OF THE INVENTION

The present invention relates to a warp-knitted loop net fabric that is particularly well-suited for use as a medium on which microorganisms can grow in a supported microbiological matrix for use in the removal or transformation of undesirable substances by microbial action in the treatment of industrial and municipal wastewater.

One form of medium that is known for use in supporting microorganisms in wastewater treatment tanks is an array of individual rope-like strands of textile material having many loops sticking out from the surface. A material of this nature is sold under the name "Ringlace." The strands of loops are individually strung with spaces between them in frames, and numerous frames are supported vertically in the treatment tank. The wastewater being treated flows through the array of strands, and the substances of interest to the microorganisms growing on the surfaces of the fibers and the bodies of the strands are transformed. Various treatments of wastewater by microorganisms are, of course, well-known per se. The warp-knitted loop net fabric of the present invention is useful in many microbiological processes carried out in a supported microorganism growth tank.

The previously known rope-like strands are costly to manufacture, and their use requires relatively complicated frames to maintain each strand in position and tedious, time-consuming labor to string the individual strands in the frames. Because of the difficulty of installing the strands, the manufacturer of the strands sells them preinstalled in the frames at a significant additional cost to the end user.

SUMMARY OF THE INVENTION

One object of the present invention is to provide a warp-knitted loop net fabric having a construction that provides a large total area of exposed loops per unit area of the fabric. Another object is to provide a fabric that is considerably easier to install in a tank than are individual strands, thereby permitting the use of simpler and less costly supporting frames and permitting large savings of the labor costs required to install the microorganism-supporting medium. Yet another object is to provide a fabric that can be manufactured relatively easily at low cost and that is strong and durable so that it will last for many years.

The foregoing and other objects are attained, in accordance with the present invention, by a warp-knitted loop net fabric comprising a first group of threads guided by a front bar (bar 1) and forming warp chains and a second group of threads guided by a second bar (bar 2) and forming lay-ins between overlaps and underlaps of the bar 1 threads in every course of the warp chains. The underlaps of the bar 1 warp chains are formed into loops by tensioning the bar 2 lay-in threads. A knitted net formed from two or more additional groups of threads guided by additional bars provides a groundwork that incorporates the warp chains and lay-ins from bars 1 and 2.

Usually, each of the strands of the net has one or more loops extending from the front face of the fabric in each course, thus providing a large total amount of exposed thread surface area for attachment and growth of microorganisms. As used herein, the "front" of the fabric is the side from which the loops extend and which in use faces a flow of a liquid being treated. With respect to the knitting machine, the loops are formed on the back of the fabric by the tensioned, laid-in bar 2 threads, which pull out the underlaps of the bar 1 threads. By fully threading bar 1 and bar 2, the number of loops present in the fabric is maximized, even though the loops end up gathered into groups at each course in each strand of the net. A fabric according to the present invention may, however, also be made by only partially threading bar 1 and bar 2. Also, by adjusting tensions, loops may be formed in every other course or in any desired pattern. The warp chains and lay-ins (where the latter are included in the net construction) of the groundwork net also provide growth sites for the microorganisms.

The openings between the strands of the net, on the other hand, allow for excellent flow conditions for the wasterwater being treated and enable the supported media tank to remain in service for long periods before it becomes clogged with organisms and requires backwashing to reduce the population of the organisms. The fact that only large panels of the net are handled and supported in the frames means that the time required to string the net material is a fraction of that required to string individual strands. The fabric is dimensionally stable, as compared with individual strands that have to be individually held in place, so the framework required for supporting the fabric in a tank can be of simpler and less expensive design.

The warp chains with extending loop elements formed from the threads on bars 1 and 2 can be incorporated into warp-knitted nets of almost any construction. For example, the groundwork net may have strands formed from threads guided by bars 3 and 4 and knitted half-gauge in opposition to each other. Alternatively, the net can be formed of third, fourth and fifth groups of threads, the third group being fully threaded on bar 3 and each thread of the third group forming a chain stitch in opposition to bar 1, and the bar 4 and bar 5 groups of threads being partially threaded and forming lay-ins in different pluralities of adjacent wales of the bar 1 and bar 3 loop chains, the lay-ins of the fourth group being in opposition to and the mirror image of the lay-ins of the fifth group.

Each thread of the bar 1 threads may form a chain in a single wale or may form a chain composed of loops in one wale in every other course and loops in an adjacent wale in the remaining courses. In the latter case, each thread of the second group (the bar 2 threads) may form a lay-in under the underlaps of the same warp chain or a lay-in under the underlaps of one warp chain in every other course and a lay-in in an adjacent warp chain in the remaining courses.

For a better understanding of the invention, reference may be made to the following description of exemplary embodiments, taken in conjunction with the accompanying drawings, which are photographs of one embodiment.

DESCRIPTION OF THE EMBODIMENTS

Figure 1:
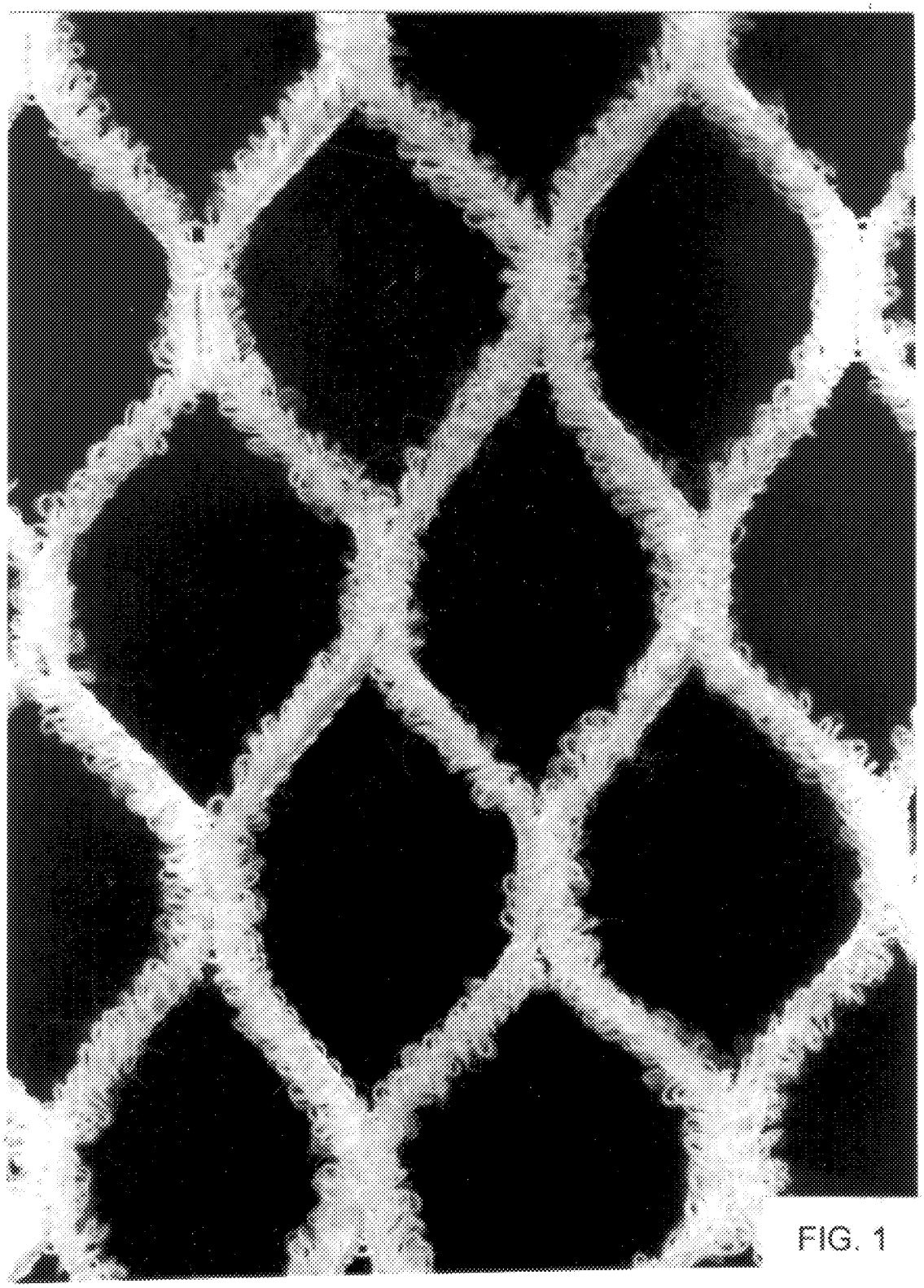
FIGS. 1 and 2 show the front side (loop side) and back side, respectively, of an embodiment.
Figure 2:
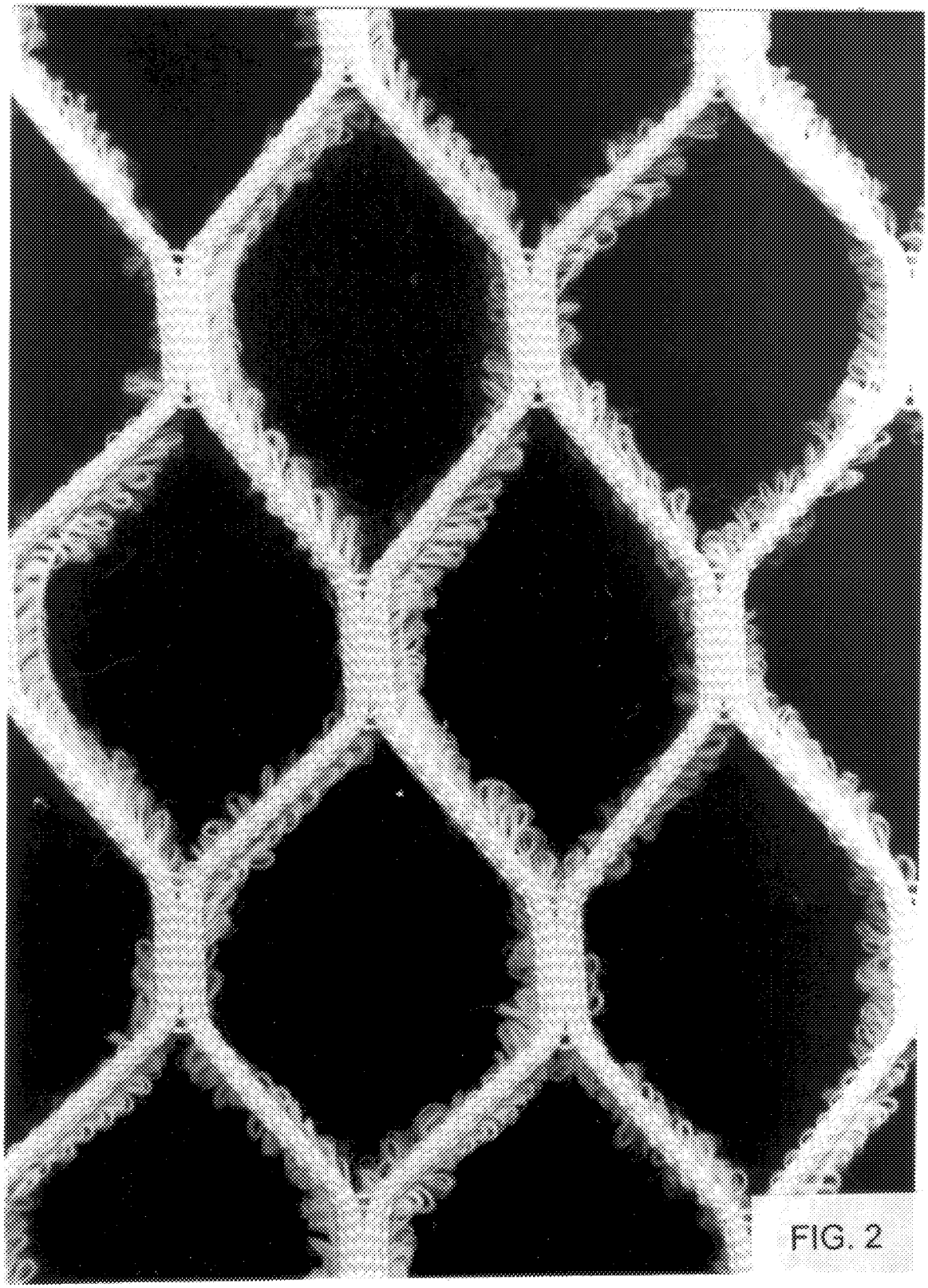

The fabric shown in the drawings is of the following construction (in the notations for bars 4 and 5, the superscript numbers indicate repetitions of the movements of the bars):

Bar 1: 2/0 0/2 Threaded Solid

Bar 2: 0/0 2/2 Threaded Solid

Bar 3: 0/2 2/0 Threaded Solid

Bar 4: $(0/0\ 12/12)^6$ $(6/6\ 12/12)^8$ $(6/6\ 18/18)^6$ $(6/6\ 12/12)^9$ Threaded 1 in 5 out Bar 5: $(18/18\ 6/6)^6$ $(12/12\ 6/6)^8$ $(12/12\ 0/0)^6$ $(12/12\ 6/6)^9$ Threaded 1 in 5 out The groundwork net in this example has (1) warpwise strands of several courses each, each warpwise strand being formed by six adjacent knitted loop chains of bar 1 and bar 3 threads and bar 2 loop-forming elements that are joined by bar 4 and bar 5 threads running in opposition in each course and (2) diagonal strands of several courses, each diagonal strand being formed by three knitted loop chains of bar 1 and bar 3 threads and bar 2 loop-forming elements that are joined by either bar 4 or bar 5 threads.

Figure 3:
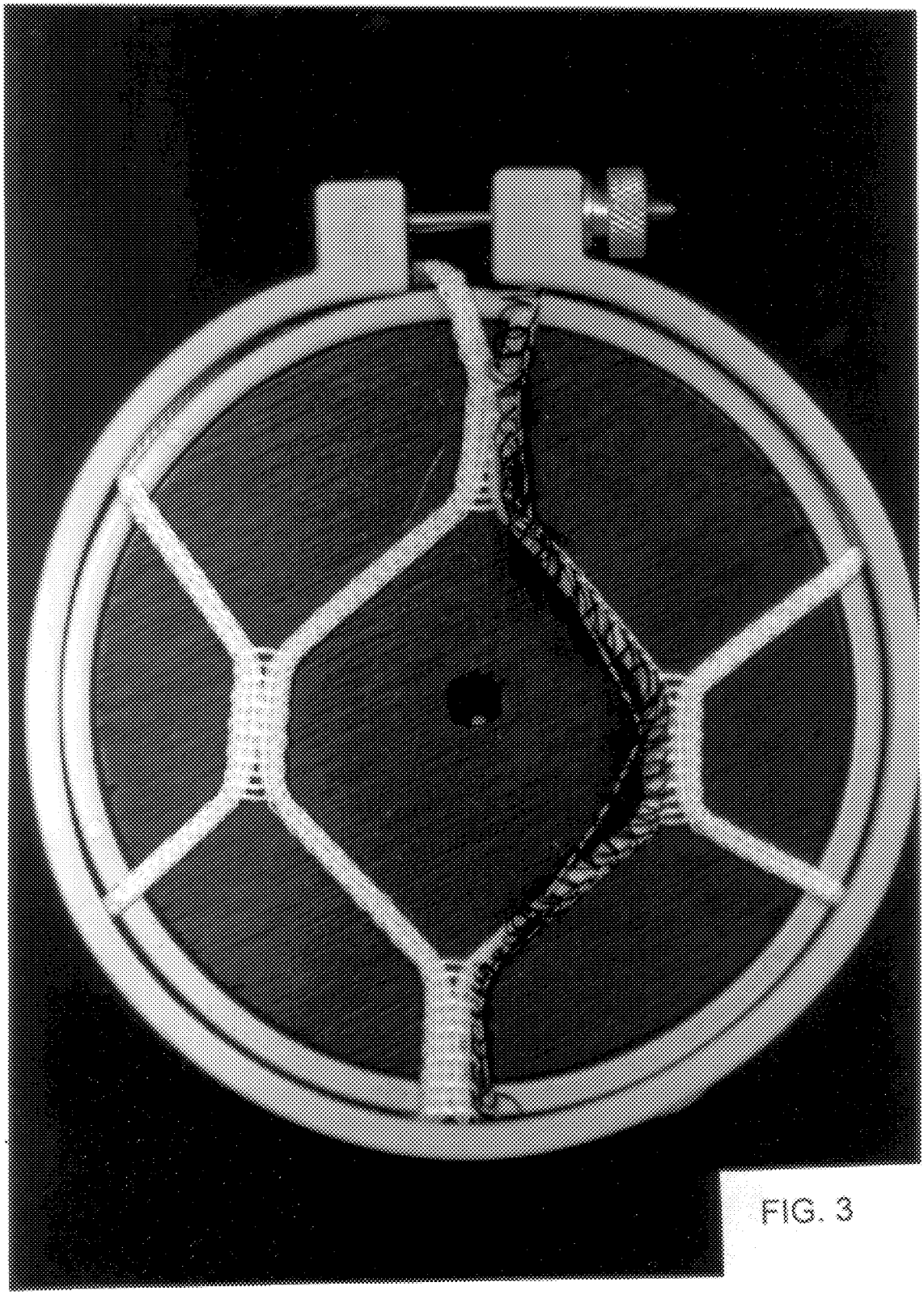
FIG. 3 shows the front side of a fabric that has been specially made to illustrate the forming of the loops from the bar 1 warp chains—the fabric being the same as that shown in FIGS. 1 and 2 but having only single threads forming one loop chain on bar 1 and one lay-in from bar 2.

In particular, fully threaded bar 1 knits in every course, and fully threaded bar 2 lays in between the overlap and the underlap in each course of each bar 1 warp chain. The bar 2 threads are highly tensioned so that they pull the underlaps of the bar 1 chains out a substantial distance to form the loops. The single black thread in FIG. 3 is a bar 1 warp chain, and the single white thread caught in the loops is the tensioned bar 2 thread that causes the loops to be formed. Only one bar 1 thread and one bar 2 thread working with a single needle were used to make the illustrative special fabric shown in FIG. 3. The remainder of the fabric shown in FIG. 3 is a net that provides a groundwork for the loop chain elements formed by bars 1 and 2.

In the groundwork net of this example, fully threaded bar 3 knits in every course, thus forming warp chains doubled with the bar 1 chains but of opposite hand. Bars 4 and 5 traverse the bar 3 warp chains in opposition to each other and are caught in the underlaps of groups of either three or six bar 3 warp chains in every course. In the example, the diagonal strands, the arms, of the net consist of groups of three bar 1 chains and bar 3 chains, which are joined in every course, alternately widthwise, by the bar 4 or the bar 5 lay-ins, one diagonal strand of each mesh opening being formed by a bar 4 thread and the other by a bar 5 thread, for several courses (e.g., bar 4, 6/6 12/12; bar 5, 12/12 6/6. In other words, each of the diagonal stands consists of three bar 1 and bar 3 wales joined in every course by either bar 4 or bar 5 lay-ins.

The diagonal strands of three wales each are connected at intervals by several courses (12 in the example) that form warpwise strands of the net in which the bar 4 and bar 5 threads together join six adjacent bar 1 and bar 3 wales. That is, a bar 4 and a bar 5 thread are laid in together but in opposite directions in each group of six adjacent wales of double loop chains formed by bars 1 and 3. In the warpwise direction, the adjacent junctures of six wales, each formed by a bar 4 thread and a bar 5 thread, are offset laterally by three wales back and forth such that each strand of three wales formed by a bar 4 or a bar 5 thread is joined alternately to a strand laterally on one side and then to a strand laterally on the other side, thus forming the diamond pattern.

The size of the net openings can, of course, be varied by changing the number of courses in each sequence of the bar 4 and bar 5 lay-ins that form the diagonal and/or the warpwise strands. The following construction is a net that is essentially the same as that shown in the photographs except that the openings are larger. The fabric is knitted on a 24 gauge Raschel machine.

Bar 1: 150 denier, two-ply; runner length 510"; 238 ends of yarn per panel; threaded solid; knitting construction 2/0 0/2

Bar 2: 150 denier, single ply; runner length 30"; 238 ends of yarn per panel; threaded solid; knitting construction 0/0 2/2

Bar 3: 1000 denier, single ply; runner length 138.75"; 238 ends of yarn per panel; knitting construction 0/2 2/0

Bar 4: 1000 denier, single ply; runner length 90"; 42 ends of yarn per panel; threaded one in, five out; knitting construction $(0/0\ 12/12)^5$ 4/4 12/12 $(6/6\ 12/12)^{15}$ 6/6 14/14 $(6/6\ 18/18)^5$ 6/6 14/14 $(6/6\ 12/12)^{16}$ 4/4 12/12

Bar 5: 1000 denier, single ply; runner length 90"; 42 ends of yarn per panel; threaded one in, five out; knitting construction $(18/18\ 6/6)^5$ 14/14 6/6 $(12/12\ 6/6)^{15}$ 12/12 4/4 $(12/12\ 0/0)^5$ 12/12 4/4 $(12/12\ 6/6)^{16}$ 14/14 6/6

The heights of the loops can be varied by changing the quality and tension—the shorter the quality and the greater the tension, the higher the loops, and vice versa. A loop net fabric, according to the invention, can be formed from loop-forming bar 1 and 2 elements on any warp-knit net that has its own integral construction. The following constructions are exemplary.

In the construction immediately below, the groundwork net is formed by bars 3 and 4, knitting in opposition.

Bar 1: 2/0 0/2 Threaded Solid

Bar 2: 0/0 2/2 Threaded Solid

Bar 3: 2/0 2/4 4/6 4/2 Threaded Half-gauge

Bar 4: 4/6 4/2 2/0 2/4 Threaded Half-gauge

In the following construction, the loop-forming threads of bar 1 are knitted on different wales in alternation, and the lay-ins are formed in the same wales. The lay-ins in this example can also lay in in different wales. The groundwork net is knitted on bars 3, 4 and 5.

Bar 1: 2/0 4/6 Threaded solid

Bar 2: 0/0 0/0 Threaded solid

Bar 3: 2/0 0/2 Threaded solid

Bar 4: 2/0 2/4 2/0 4/6 4/2 4/6 Threaded Half-gauge

Bar 5: 4/6 4/2 4/6 2/0 2/4 2/0 Threaded Half-gauge

I claim:

1. A warp-knitted loop net fabric comprising a first group of threads forming warp chains of stitches knitted by a front bar, a second group of threads guided by a second bar and forming lay-ins between overlaps and underlaps of the first group of threads in every course of the warp chains, the underlaps of the warp chains of the first group of threads being loops formed by tensioning the threads of the second group, and a knitted net forming a groundwork incorporating the warp chains and lay-ins.

2. A fabric according to claim 1 wherein each thread of the first group forms a chain in a single wale.

3. A fabric according to claim 1 wherein each thread of the first group forms a chain composed of loops in one wale in every other course and loops in a different wale in the remaining courses.

4. A fabric according to claim 3 wherein each thread of the second group forms a lay-in between the overlaps and underlaps of a single warp chain of a thread of the first group.

5. A fabric according to claim 3 wherein each thread of the second group forms a lay-in between the overlaps and underlaps of one warp chain in every other course and a lay-in in a different warp chain in each of the remaining courses.

6. A fabric according to claim 1 wherein the net is formed of chains knitted from third and fourth groups of threads from third and forth bars threaded half-gauge and knitting in opposition to each other.

7. A fabric according to claim 1 wherein the knitted net if formed of third, fourth and fifth groups of threads, the third group being on a third bar and each thread of the third group forming a chain, and the fourth and fifth groups of threads being partially threaded on fourth and fifth bars and being lay-ins between the overlaps and underlaps of different pluralities of adjacent wales of the loop chains, the lay-ins of the fourth group being in opposition to and a mirror image of the lay-ins of the fifth group.

* * * * *